US005438933A

United States Patent [19]

Lipsius et al.

[11] Patent Number: 5,438,933

[45] Date of Patent: Aug. 8, 1995

[54] RUNNING GEAR FOR A RAILBORNE VEHICLE WITH RADIAL ADJUSTABILITY

[75] Inventors: Johann M. Lipsius; Wolfgang Auer, both of Kassel, Germany

[73] Assignee: ABB Patent GmbH, Mannheim, Germany

[21] Appl. No.: 203,412

[22] Filed: Feb. 28, 1994

[30] Foreign Application Priority Data

Feb. 27, 1993 [DE] Germany ..... 43 06 114.1

[51] Int. Cl.[6] ..... B61F 5/38

[52] U.S. Cl. ..... 105/168

[58] Field of Search ..... 105/165, 167, 168, 218.2

[56] References Cited

U.S. PATENT DOCUMENTS 4,519,329 5/1985 Vacher ..... 105/168
4,640,198 2/1987 Haupl ..... 105/168
4,982,671 1/1991 Chollet et al. ..... 105/168
5,249,530 10/1993 Wike ..... 105/168

FOREIGN PATENT DOCUMENTS 3004082 8/1981 Germany ..... 105/168
3123858 12/1982 Germany .
3827412 1/1991 Germany .

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A railborne vehicle has at least two wheelsets. A running gear includes compensating levers for radially adjusting the wheelsets, and at least one independently controlled control cylinder for influencing a rotary motion of at least one of the compensating levers.

7 Claims, 2 Drawing Sheets

RUNNING GEAR FOR A RAILBORNE VEHICLE WITH RADIAL ADJUSTABILITY

BACKGROUND OF THE INVENTION

1. Field of the Invention

The invention relates to a running gear or undercarriage for a railborne vehicle, which can be used both with locomotives and non-driven railborne vehicles, and which has at least two wheelsets that are radially adjustable through compensating levers.

Such a running gear for a railborne vehicle with radial adjustability is known from German Patent DE 38 27 412 C2. In radial controls, the adjustment of the wheelsets is effected by means of longitudinal forces that arise at contact surface points of the wheels as they travel around curves.

A horizontal restoring force of wheelset springs restricts the radial adjustability of the wheelsets. As a remedy, the horizontal spring characteristic can be reduced by employing softer wheelset springs. However, that provision disadvantageously reduces running stability.

SUMMARY OF THE INVENTION

It is accordingly an object of the invention to provide a running gear for a railborne vehicle with radial adjustability, which overcomes the hereinafore-mentioned disadvantages of the heretofore-known devices of this general type and in which the radial adjustability is not lowered by the horizontal restoring force of the wheelset springs.

With the foregoing and other objects in view there is provided, in accordance with the invention, in a railborne vehicle having at least two wheelsets, a running gear, comprising compensating levers for radially adjusting the wheelsets; and at least one independently or externally controlled control cylinder for influencing a rotary motion of at least one of the compensating levers.

The advantages attainable with the invention reside in particular in the fact that the disruptive influences of the horizontal restoring forces of the wheelset springs during radial control are compensated for by suitable impingement on or adjustment of the control cylinder. As a result, particularly at short curve radii, in which greater horizontal deflections of the wheelset springs are required because of the radial control, the radial controllability is improved. Since the spring characteristic of the wheelset spring that is essential for the radial control is preserved in the crosswise direction (at right angles to the direction of travel), the use of the control cylinder does not have any negative effect on the running stability. On the contrary, the running stability is preserved in its entirely, since recourse need not be made to the employment of softer wheelset springs.

It is known from German Patent DE 30 04 084 C2 to employ a control cylinder to control the swiveling motion of a wheelset of a railborne vehicle in a curve. Unlike that configuration, the use of the control cylinder according to the invention serves not only to control the swiveling motion of the wheelset during travel on curves itself but instead the control force exerted by the control cylinder during travel on curves serves exclusively to overcome the horizontal restoring forces of the wheelset springs. The swiveling motion of the wheelset is brought about solely by the radial control.

In accordance with another feature of the invention, the vehicle has a truck frame, and the at least one control cylinder has a first articulation point connected to the truck frame and a second articulation point connected to at least one of the compensating levers.

In accordance with a further feature of the invention, there is provided a pivot lever through which the second articulation point is connected to at least one of the compensating levers.

In accordance with an added feature of the invention, the vehicle has a truck with right and left sides at which the compensating levers are disposed, and there is provided a pivot shaft through which the compensating levers of the right and left sides of the truck are coupled to one another, the at least one control cylinder being separate control cylinders each being disposed on a respective side of the truck.

In accordance with an additional feature of the invention, the vehicle has a truck with right and left sides at which the compensating levers are disposed, and there is provided a pivot shaft through which the compensating levers of the right and left sides of the truck are coupled to one another, the at least one control cylinder being one control cylinder disposed on only one side of the truck.

In accordance with yet another feature of the invention, the vehicle has a truck with right and left sides at which the compensating levers are disposed, and the at least one control cylinder is two control cylinders acting in opposite directions.

In accordance with a concomitant feature of the invention, the vehicle has a truck with right and left sides at which the compensating levers are disposed, and the at least one control cylinder is two control cylinders being triggered in opposite directions.

Other features which are considered as characteristic for the invention are set forth in the appended claims.

Although the invention is illustrated and described herein as embodied in a running gear for a railborne vehicle with radial adjustability, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
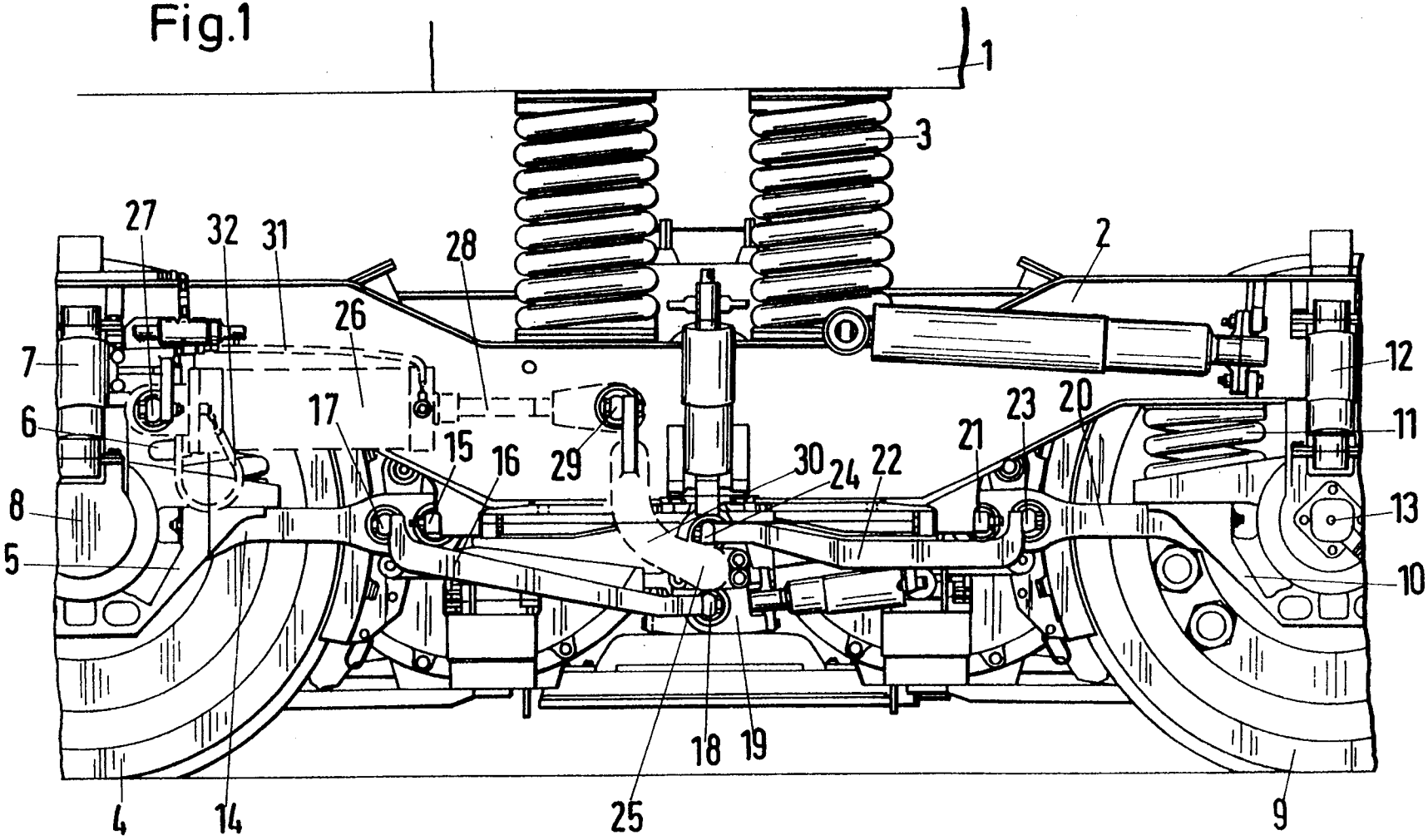
FIG. 1 is a fragmentary, diagrammatic, side-elevational view of a running gear for a railborne vehicle with radial adjustability having a tandem construction of wheelset guide rods/connecting guide rods.

Referring now to the figures of the drawing in detail and first, particularly, to FIG. 1 thereof, there is seen a running gear or undercarriage for a railborne vehicle with radial adjustability having a tandem construction of wheelset guide rods/connecting guide rods. A bogie or truck frame 2 is suspended from a car box 1 of a railborne vehicle. Spring elements 3 serve to provide suspension for the car box 1. Two wheel sets are suspended from the bogie or truck frame 2. A first wheel 4 of a first wheelset and a first wheel 9 of a second wheelset can be seen. An axle bearing housing 5 with a wheelset bearing of the first wheel 4 of the first wheelset is supported on the bogie or truck frame 2 through wheelset spring elements 6 and wheelset damping elements 7. A first wheelset axle is indicated by reference numeral 8.

An axle bearing housing 10 with a wheelset bearing of the first wheel 9 of the second wheelset is supported in the same manner on the bogie or truck frame 2 through wheelset spring elements 11 and wheelset damping elements 12. A second wheelset axle is identified by reference numeral 13.

A wheelset guide rod 14 is connected rigidly to the axle bearing housing 5 on one end and pivotably to the bogie or truck frame 2 on the other end through a wrist point 15. The wrist point 15 is displaceable horizontally but not vertically and represents a pivot point for deflections of the wheelset guide rod 14. A connecting guide rod 16 serves to couple the wheelset guide rod 14 to a compensating lever 19. To that end, the guide rod 16 is connected both to the wheelset guide rod 14 through an articulation point 17, and to the compensating lever 19 through an articulation point 18.

In the same way, a wheelset guide rod 20 is connected rigidly to the axle bearing housing 10 on one end and pivotably to the bogie or truck frame 2 on the other through a wrist point 21. The wrist point 21 is displaceable horizontally but not vertically and represents a pivot point for deflections of the wheelset guide rod 20. A connecting guide rod 22 serves to couple the wheelset guide rod 20 to the compensating lever 19. To that end, the guide rod 22 is connected both to the wheelset guide rod 20 through an articulation point 23, and to the compensating lever 19 through an articulation point 24.

A pivot point 25 of the compensating lever 19 is located centrally between the two articulation points 18, 24, and in the position of repose, in other words when the railborne vehicle is traveling straight ahead, these articulation points are oriented vertically.

As can be seen from the geometrical configuration of the connections between the wheelset guide rods 14, 20, the connecting guide rods 16, 22 and the compensating lever 19, the result when the railborne vehicle travels around curves is radial control that is symmetrical with respect to the two wheelsets. If the two wheels 4, 9 are running on the rail on the inside of the curve, then the compensating lever 19 executes a counterclockwise rotary motion about the pivot point 25, and as a result the distance between the two axle bearing housings 5, 10 decreases in comparison with the position of repose. If the two wheels 4, 9 are running on the rail on the outside of the curve, then the compensating lever 19 executes a clockwise rotary motion about the pivot point 25, and as a result the distance between the two axle bearing housings 5, 10 increases in comparison with the position of repose.

A control cylinder 26 is secured to the bogie or truck frame 2 through an articulation point 27. A piston rod 28 of the control cylinder 26 is connected through an articulation point 29 to a pivot lever 30 that is rigidly secured to the compensating lever 19. The control cylinder 26 may be a bidirectional hydraulic cylinder, for example. Pressure can be exerted upon the control cylinder 26 in a suitable way through hydraulic hoses 31, 32, so that a compressive or tensile force acting in the direction of rotation about the pivot point 25 can be exerted upon the compensating lever 19 through the piston rod 28 and the pivot lever 30.

Figure 2:
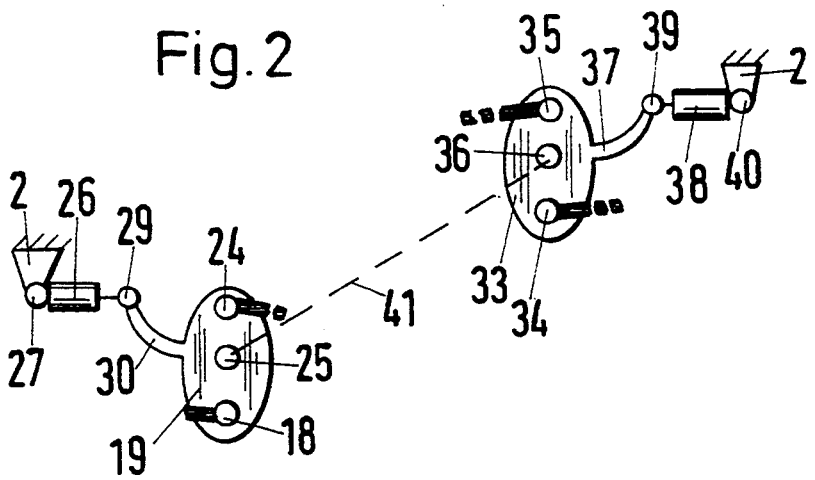
FIG. 2 is a perspective view of a variant with compensating levers on right and left sides of the bogie or truck that can be coupled selectively with one another through a pivot shaft.

FIG. 2 shows a variant with compensating levers on the right and left sides of the bogie or truck that can be coupled selectively with one another through a pivot shaft. In this perspective view, both compensating levers 19, 33 of both sides of the bogie or truck can be seen. Through the use of the pivot lever 30 and the articulation point 29, the compensating lever 19 can be influenced in its rotary motion about the pivot point 25 by the control cylinder 26. Another end of the control cylinder 26 is mounted on the bogie or truck frame 2 through the articulation point 27. In the same way, the compensating lever 33 on the other side of the bogie or truck can be influenced in its rotary motion about a pivot point 36 through the use of a pivot lever 37 and an articulation point 39, by a control cylinder 38. The control cylinder 38 has another end being secured to the bogie or truck frame 2 through an articulation point 40.

The drawing indicates that the articulation points 18, 24 of the compensating lever 19 and articulation points 34, 35 of the compensating lever 33 are connected to guide rods (wheelset guide rods or connecting guide rods).

The two compensating levers 19, 33 may, but need not, be coupled together through a rigid pivot shaft 41.

In either case, with or without coupling of the two compensating levers through a pivot shaft, a contrary motion of the piston rods of the control cylinders 26, 38 results. In other words, the piston rod of the control cylinder 26 enters farther into the cylinder when the piston rod of the control cylinder 38 emerges from the cylinder, and vice versa. As a result, the influence of the wheelset springs of the two sides of the bogie or truck that is disruptive in the radial control is advantageously compensated for.

If the compensating levers are joined to one another through a pivot shaft, then in a deviation from FIG. 2 it is also possible to provide only one control cylinder, which then influences both sides of the bogie or truck through the pivot shaft.

If two control cylinders are provided in a variant with a pivot shaft, then both control cylinders must act in the same direction of moment. This is done either by structurally configuring the control cylinders accordingly or by actuating them in opposite directions.

Figure 3:
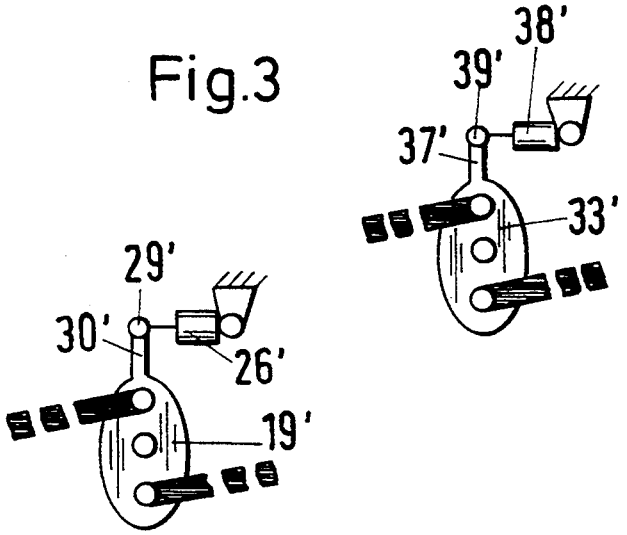
FIG. 3 is a perspective view of a variant without compensating levers being coupled through a pivot shaft.

FIG. 3 shows a variant without compensating levers being coupled through a pivot shaft. In this version without a pivot shaft, the connecting guide rods may also be selectively disposed in the same direction on the right and left sides of the bogie or truck. Control cylinders 26′ and 38′ are accordingly actuated in contrary directions. In the variant of FIG. 3, it is additionally seen that pivot levers 30′, 37′ need not be bent in the form of a crank but may instead be constructed to be straight. What is essential is a developing lever arm between pivot points of compensating levers 19', 33' and articulation points 29', 39' that are engaged by the control cylinders.

Figure 4:
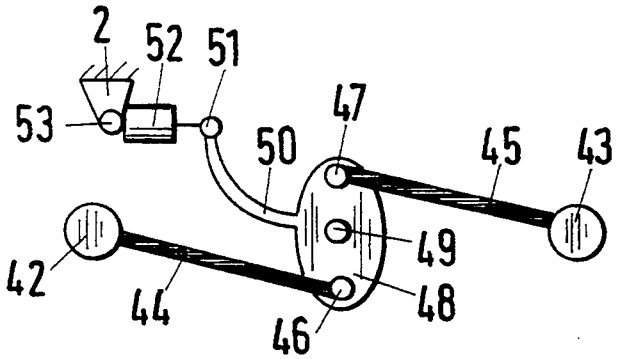
FIG. 4 is a side-elevational view of a running gear for a railborne vehicle with radial adjustability.

FIG. 4 shows a running gear for a railborne vehicle with radial adjustability. This running gear does not have the tandem guide rod construction of FIG. 1. Instead, wheelset bearing/axle bearing housings 42 and 43 are secured directly through respective wheelset guide rods 44 and 45 to articulation points 46 and 47 of a compensating lever 48. A control cylinder 52 is mounted through an articulation point 53 to the bogie or truck frame 2 and through an articulation point 51 to the pivot lever 50 of the compensating lever 48, so that influence on the rotation of the compensating lever 48 about its pivot point 49 by the control cylinder is possible.

We claim:

1. In a railborne vehicle having at least two wheelsets and wheelset springs, a running gear, comprising:

wheelset guide rods and compensating levers connecting the wheelsets, said wheelset guide rods and compensating levers radially adjusting the wheelsets through longitudinal forces acting when the running gear travels a curve; and at least one independently controlled control cylinder for influencing a rotary motion of at least one of said compensating levers, a radial control of said compensating levers controlling a steering movement of the respective wheelset during travel through the curve, and a control force of said control cylinder, during the travel through the curve, exclusively acting against a horizontal restoring force of the wheelset springs.

2. The running gear according to claim 1, wherein the vehicle has a truck frame, and said at least one control cylinder has a first articulation point connected to the truck frame and a second articulation point connected to at least one of said compensating levers.

3. The running gear according to claim 2, including a pivot lever through which said second articulation point is connected to at least one of said compensating levers.

4. The running gear according to claim 1, wherein the vehicle has a truck with right and left sides at which said compensating levers are disposed, and including a pivot shaft through which said compensating levers of the right and left sides of the truck are coupled to one another, said at least one control cylinder being separate control cylinders each being disposed on a respective side of the truck.

5. The running gear according to claim 1, wherein the vehicle has a truck with right and left sides at which said compensating levers are disposed, and including a pivot shaft through which said compensating levers of the right and left sides of the truck are coupled to one another, said at least one control cylinder being one control cylinder disposed on only one side of the truck.

6. The running gear according to claim 1, wherein the vehicle has a truck with right and left sides at which said compensating levers are disposed, and said at least one control cylinder is two control cylinders acting in opposite directions.

7. The running gear according to claim 1, wherein the vehicle has a truck with right and left sides at which said compensating levers are disposed, and said at least one control cylinder is two control cylinders being triggered in opposite directions.

* * * * *